US005645030A

United States Patent [19]

Letsche

[11] Patent Number: 5,645,030

[45] Date of Patent: Jul. 8, 1997

[54] MOTORBRAKE FOR A DIESEL ENGINE

[75] Inventor: Ulrich Letsche, Stuttgart, Germany

[73] Assignee: Daimler-Bauz AG, Stuttgart, Germany

[21] Appl. No.: 680,449

[22] Filed: Jul. 15, 1996

[30] Foreign Application Priority Data

Aug. 4, 1995 [DE] Germany ..... 195 28 792.4

[51] Int. Cl.[6] ..... F02D 13/04

[52] U.S. Cl. ..... 123/321

[58] Field of Search ..... 123/321, 322, 123/90.12, 347, 320

[56] References Cited

U.S. PATENT DOCUMENTS

| | | | |
|---|---|---|---|
| 4,150,640 | 4/1979 | Egan | 123/321 |
| 4,271,796 | 6/1981 | Sickler et al. | 123/321 |
| 4,398,510 | 8/1983 | Custer | 123/90.16 |
| 4,475,500 | 10/1984 | Bostleman | 123/321 |
| 4,662,332 | 5/1987 | Bergmann et al. | 123/321 |
| 4,697,558 | 10/1987 | Meneely | 123/321 |
| 4,898,128 | 2/1990 | Meneely | 123/90.12 |
| 5,000,146 | 3/1991 | Szucanyi | 123/321 |

FOREIGN PATENT DOCUMENTS

| | | | |
|---|---|---|---|
| 0702133 | 3/1996 | European Pat. Off. | 123/321 |
| 3904497 | 1/1990 | Germany . | |

*Primary Examiner*—Raymond A. Nelli
*Attorney, Agent, or Firm*—Klaus J. Bach

[57] ABSTRACT

In a motorbraking arrangement for a Diesel engine with at least one engine breathing valve and at least one fuel injector per cylinder and a high pressure fuel pump with a high pressure fuel reservoir for supplying high pressure fuel to the injectors, a control valve is provided for controlling the supply of fuel from the high pressure fuel reservoir to the breathing valve for its actuation during an engine compression stroke and a lower pressure fluid supply system is provided for operating the breathing valve during normal engine operation under the control of switch-over means which place the breathing valve in communication either with the high pressure fuel reservoir or with the lower pressure fluid supply system.

6 Claims, 1 Drawing Sheet

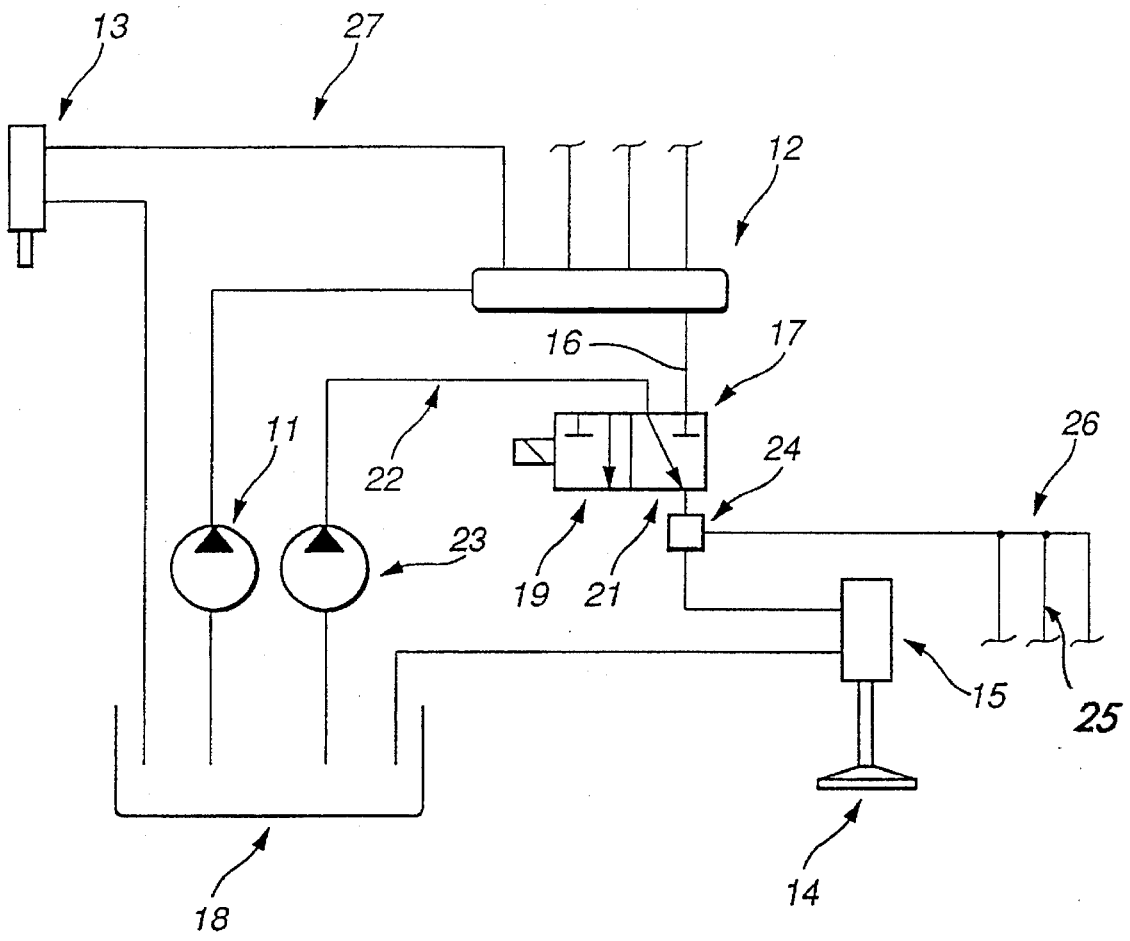
13
27
12
16
17
11
22
24
26
23
19
21
15
25
14
18

MOTORBRAKE FOR A DIESEL ENGINE

BACKGROUND OF THE INVENTION

The present invention relates to a motorbrake for a Diesel engine with engine breathing valves and a fuel injector mounted in each cylinder for injecting fuel supplied by a high pressure pump via a common rail distribution line, and means for operating a valve during an engine compression stroke by high pressure fuel from the common rail distribution line to provide for motor braking.

Motorbrake systems for commercial vehicle internal combustion engines with a motorbrake flap valve arranged in the exhaust pipe so as to be controllable for decelerating the vehicle are well known. It is also known to equip the engine with decompression valves which are maintained open during engine braking operation (constant-throttle valves) to thereby increase engine braking effectiveness.

DE 39 04 497 C1 discloses a decompression braking arrangement with a hydraulic operating device for actuating an exhaust valve by the fuel injection pump of the engine. For this purpose, the fuel pipe from the injection pump to the injector includes a control valve which blocks the fuel flow to the injector and provides a flow path to the hydraulic operating device for actuating the exhaust valve during the compression stroke of the engine.

Also known is a decompression brake arrangement wherein the engine is provided with a common high pressure fuel supply line (common rail) for supplying fuel to the various fuel injectors under the control of individual magnetically controlled valves and wherein the fuel in the common rail is used for the operation of the various decompression valves. This permits a free selection of the braking power since the opening and closing points of the decompression valves can be controlled while no fuel is admitted to the injectors. The fuel pressure in the common rail remains essentially constant so that high pressure fuel is always available for supply to the injectors or for operation of the decompression valves.

It is the object of the present invention to provide an improved motorbrake system wherein, over the whole operating range of an engine, a braking power can be achieved which is freely selectable so as to be optimally adapted to prevailing conditions and wherein the operating pressure of the fuel can be optimized for motorbrake operation or for normal engine power operation.

SUMMARY OF THE INVENTION

In a motorbraking arrangement for a Diesel engine with at least one engine breathing valve and at least one fuel injector per cylinder and a high pressure fuel pump with a high pressure fuel reservoir for supplying high pressure fuel to the injectors, a control valve is provided for controlling the supply fuel from the high pressure fuel reservoir to the breathing valve for its actuation during an engine compression stroke and a lower pressure fluid supply system is provided for operating the breathing valve during normal engine operation under the control of switch-over means which place the breathing valve in communication either with the high pressure fuel reservoir or with the lower pressure fluid supply system.

Since the engine breathing valve (generally the outlet valve) is operated during motorbraking operation by high pressure fuel as available from the common high pressure fuel supply line (common rail) which, at the same time, is part of the fuel injection system of the internal combustion engine and, during normal engine operation, by a fluid pressure system which is different from the pressure level prevalent in the common rail, the pressure can be optimized with regard to the required valve operating energy. In this way, the losses of the engine resulting from the generation of the high pressure level in the common rail can be substantially reduced since, during normal engine operation, the valves are operable at a lower operating fluid pressure.

Advantageous embodiments of the invention are described in greater detail on the basis of the enclosed drawing.

BRIEF DESCRIPTION OF THE DRAWING

The sole figure shows a motorbrake system according to the invention with an injector and an engine exhaust valve.

DESCRIPTION OF PREFERRED EMBODIMENT

The Figure show schematically a motorbraking system for a Diesel engine with a controllable high pressure pump 11 which supplies fuel under high pressure to a high pressure fuel reservoir 12 which is a common fuel supply line (common rail) for magnetic valve controlled injection nozzles 13 mounted on a cylinder. In addition to an injection nozzle 12, each cylinder includes breathing valves 14 (intake and exhaust valves) for controlling the gas flow through the cylinder. The intake and exhaust valves are hydraulically operable by way of control valves 15 for timely opening and closing the valves 14. A valve 14 is in communication with the common rail 12 by way of a supply line 16 which, downstream of the common rail 12, includes a switch-over device 17 in the form of a 3/2 way valve. The 3/2 way valve 17 controls the flow connection between the common rail 12 and the control valve 15 as well as the flow connection between a fuel tank 18 and the valve 14.

During normal engine operation, the 3/2 way valve 17 is in the operating position 21 wherein the valve 14 is operable by fuel supplied directly from the fuel tank 18 through a fuel supply line 22. The fuel supply line 22 includes a controllable pressure pump 23 which supplies fuel under a pressure of, for example, 200 to 300 bar to satisfy the valve operating requirements of the engine during normal engine operating conditions.

During engine braking operation the 3/2 way valve 17 is in the position as shown in block 19 (the block 21 being replaced by block 19) wherein a direct communication path is provided between the common rail 12 and the valve 14 so that the pressurized fuel from the common rail 12, wherein the fuel may be under a pressure of over 1000 bar, is supplied to the valve 14. In this manner, the high forces required to open the valve 14 against the high compressed gas pressure in the cylinder in the area of the top dead center position of the piston can be provided.

By operating the valve 14 during motorbraking operation by fuel taken from the common rail 12, the exhaust valve 14 can be actuated against the compressed air pressure in the cylinder to be opened either fully or partially while the high pressure fuel pump 11 needs to supply only a relatively small amount of fuel to the common rail as it is needed for the actuation of the outlet valve 14 since, during engine braking operation, no fuel is supplied to the injectors.

With the switch-over device 17 arranged in the fuel supply lines 16 and 22 between the common rail 12 and the pump 23 on one side and the valve 14 on the other, optimal operation of the valve 14 with regard to operating energy requirements is possible since the energy required for operating the high pressure pump 11 since, during normal engine operation, the fuel for operating the exhaust valve 14 is taken from the lower pressure pump 23 which requires substantially less energy for supplying the fuel under a substantially lower pressure.

The arrangement described above has the advantage that the intake and exhaust valve controls and the pressurized fuel supplies therefor can be designed for normal engine operating conditions. The switch-over from one to the other of the two pressurized fluid supply systems, that is, the supply of fluid for the operation of the exhaust valve from the pressure pump 23 or from the high pressure common rail 12 may be provided for by a simple common 3/2 way valve by which all exhaust valves of the whole engine can be commonly attended to.

Of course, such a switch-over device 17 may be provided not only for the switching-over between the two pressurized fluid supply systems, that is, it may not only be arranged between the common rail 12 and the valve 14 but it may be provided also between other components of an internal combustion engine which are operable by fuel under pressure. The engine may have for example a separate decompression valve adapted to be operated by fuel under pressure.

There may be for example, between the switch-over device 17 and the valve 14, another 3/2 way valve 24 by which communication with a low pressure line 26 can be established. The low pressure line 24 extends to fuel tank 18 to provide a return path for returning fuel to the tank 18 or to some other hydraulically operable device as indicated by the branch lines 25.

The braking power of the engine can be controlled by controlling the fuel pressure in the high pressure fuel reservoir, that is in the common rail, by controlling the opening and closing points of the exhaust valves of cylinders of the internal combustion engine depending on braking requirements.

What is claimed is:

1. A motorbraking arrangement for a Diesel engine with at least one engine breathing valve and at least one fuel injector per cylinder and a high pressure fuel pump with a high pressure fuel reservoir for supplying fuel under high pressure to said fuel injectors, said arrangement comprising a control valve operable for actuating said breathing valves during a compression stroke of said engine by high pressure fuel from said high pressure fuel reservoir and a lower pressure fluid supply system capable, of actuating said breathing valves during normal engine operation and, switch-over means for connecting to said valve actuating means, to said high pressure fuel reservoir during engine braking operation when no fuel is supplied to said injectors and to said lower pressure fluid supply system during normal engine operation when the valves are to be operated only against a low gas pressure in the cylinders.

2. A motorbraking arrangement according to claim 1, wherein a fuel supply line extends between said high pressure fuel reservoir and said engine breathing valve and said switch-over means is disposed in said fuel supply line and another fuel supply line extends between said switch-over means and a fuel tank, said switch-over means being adapted to control the supply of fuel to said breathing valve control valve for supplying thereto fuel under pressure as needed for the operation of the engine breathing valve.

3. A motorbraking arrangement according to claim 2, wherein said switch-over means is a 3/2 way valve.

4. A motorbraking arrangement according to claim 2, wherein said lower pressure fuel supply system includes a controllable pressure pump by which fuel can be supplied to said switch-over means from a fuel tank via another fuel supply line.

5. A motorbraking arrangement according to claim 4, wherein said low pressure pump has an operating range for providing fuel under a pressure of 150 to 350 bar.

6. A motorbraking arrangement according to claim 2, wherein said fuel supply line includes, downstream of said control valve, another control valve from which at least another fuel line branches off which leads back to said fuel tank.

* * * * *